US006519807B1

(12) United States Patent
Thomson

(10) Patent No.: US 6,519,807 B1
(45) Date of Patent: Feb. 18, 2003

(54) CLEANER HEAD ASSEMBLY FOR A VACUUM CLEANER

(75) Inventor: Andrew Walter McRae Thomson, Avening (GB)

(73) Assignee: Dyson Limited, Malmesbury (GB)

( * ) Notice: Subject to any disclaimer, the term of this patent is extended or adjusted under 35 U.S.C. 154(b) by 0 days.

(21) Appl. No.: 09/806,918

(22) PCT Filed: Oct. 4, 1999

(86) PCT No.: PCT/GB99/03271

§ 371 (c)(1),
(2), (4) Date: Apr. 6, 2001

(87) PCT Pub. No.: WO00/21427

PCT Pub. Date: Apr. 20, 2000

(30) Foreign Application Priority Data

Oct. 8, 1998 (GB) ..... 9822005

(51) Int. Cl.[7] ..... A47L 5/28
(52) U.S. Cl. ..... 15/354; 15/351
(58) Field of Search ..... 15/334, 351, 354

(56) References Cited

U.S. PATENT DOCUMENTS 2,898,621 A * 8/1959 Vance ..... 15/324
2,898,622 A * 8/1959 Hurd ..... 15/333
4,490,882 A 1/1985 Wells
4,709,442 A * 12/1987 Sletten, II ..... 15/320
5,090,083 A 2/1992 Wulff
5,319,828 A * 6/1994 Waldhauser et al. ..... 15/320
5,432,975 A * 7/1995 Hilmanowski ..... 15/320

FOREIGN PATENT DOCUMENTS

GB 2 271 275 A 4/1994

* cited by examiner

*Primary Examiner*—Chris K. Moore
(74) *Attorney, Agent, or Firm*—Morrison & Foerster LLP

(57) ABSTRACT

The invention provides a cleaner head assembly for a vacuum cleaner comprising a cleaner head body pivotably attachable to a main body of a vacuum cleaner and a brush housing pivotably mounted on the cleaner head body, the brush housing having a suction opening and a brush bar mounted therein, wherein the brush housing comprises a sealed unit connectable to a vacuum cleaner air inlet via a conduit separate from the cleaner head body. The arrangement allows the brush housing to be doubly articulated with respect to the main body of the vacuum cleaner whilst the suction opening remains in a horizontal plane without requiring the use of seals which must be able to accommodate the articulation of the brush housing.

19 Claims, 5 Drawing Sheets

CLEANER HEAD ASSEMBLY FOR A VACUUM CLEANER

This application claims priority to International Application No. PCT/GB99/03271 which was published on Apr. 20, 2000.

The present invention relates to a cleaner head assembly for a vacuum cleaner.

BACKGROUND OF THE INVENTION

An upright vacuum cleaner normally comprises a main body containing dirt and dust separating apparatus, a cleaner head rotatably mounted on the main body and having a dirty air inlet, and a motor and fan unit for drawing dirty air into the dirt and dust separating apparatus via the dirty air inlet so that dirt and dust can be separated from the airflow before the clean air is expelled to the atmosphere. The dirty-air inlet through which dirty air is sucked into the vacuum cleaner is directed downwardly so that it faces the floor to be cleaned. The dirt and dust separating apparatus can take the form of a filter bag or, as is known, can alternatively take the form of a cyclonic arrangement. The present invention is not concerned with the nature of the dirt and dust separating apparatus and is therefore applicable to vacuum cleaners utilising either arrangement.

A brush bar is supported in the dirty-air inlet so that it protrudes to a small extent from the inlet. The brush bar is activated mainly when the vacuum cleaner is used to clean carpeted surfaces. The brush bar comprises an elongate cylindrical core from which bristles extend along its length in a radial direction. The brush bar is driven by the motor via a drive belt so that the brush bar rotates within the inlet. Rotation of the brush bar causes the bristles to sweep along the surface of the carpet to be cleaned to loosen dirt and dust and pick up debris. The suction of air causes air to flow around the brush bar and underneath it to help lift the dirt and dust from the surface to be cleaned and then carry it from the dirty-air inlet to the dirt and dust separating apparatus.

It will be appreciated that the effectiveness of an upright vacuum cleaner will depend upon the amount of dirt and dust which can be picked up by the cleaner head and passed to the dirt and dust separation apparatus. For each vacuum cleaner there is an optimum configuration for the relationship between the dirty-air inlet and the carpet to be cleaned. Very often, the relationship will be one that maintains the dirty-air inlet in a plane which is parallel to the floor so that the mouth of the inlet is horizontal. Ideally then, the dirty air inlet should be maintained completely horizontal to the floor (or at the optimum angle or configuration) so that the maximum amount of air sucked into the dirty air inlet travels through the fibres of the carpet being cleaned before travelling on through the cleaner to the dirt and dust separating apparatus. However, the angle of inclination of the cleaner head to the surface may differ when the vacuum cleaner is used on different types of floor surface, eg on carpets with different piles and textures. Also, the vacuum cleaner is in use moved over the surface to be cleaned in reciprocating forwards and backwards movements so that the cleaner head travels both forwards and backwards over the surface whilst collecting dust and dirt via the dirty air inlet. In most cases the cleaner head will be acted upon in different ways by the carpet when it is travelling in different directions and will not maintain good contact on all sides of the dirty air inlet in both directions. Furthermore, the action of the user can result in the angle of inclination of the handle to the vertical being varied quite significantly during normal use and this can cause the plane of the dirty air inlet to be lifted, either at the front or the back, away from the optimum configuration. Any and all of these things can result in a reduction in the effectiveness of the suction of the cleaner head which can lead to a loss in the maximum level of pick-up and then to customer dissatisfaction.

Some attempts have been made to solve this problem by way of manually operated cleaner head lifting and lowering mechanisms by means of which the user is able to set the optimum height for the cleaner head when the cleaner is being used on a particular surface. However, these mechanisms only lift and lower the cleaner head by pivoting about the axis about which the cleaner head is connected to the main body of the cleaner. They do not address the problem of the dirty air inlet becoming inclined to the optimum configuration and thereby allowing the inlet suction to become less effective. One effective way to address this problem has been described in our copending UK patent application no. 9725777.8 which gives full details of a cradle-type arrangement for mounting the brush bar in the dirty air inlet. The brush bar is mounted in a cradle which is itself freely rotatably mounted in the cleaner head. The difficulty associated with this arrangement is that the cradle must be sealed with respect to the cleaner head and this can be difficult to achieve. The cradle must remain freely rotatable with respect to the cleaner head whilst preventing any loss of suction during use of the vacuum cleaner. The constant movement of the cradle with respect to the cleaner head affects the life of the seal between the cradle and the cleaner head so that the seal can be prone to leakages in a relatively short time.

SUMMARY OF THE INVENTION

An object of the present invention is to provide a cleaner head which maintains the suction opening of the dirty air inlet in contact with the surface to be cleaned throughout cleaning. A further object of the invention is to provide a cleaner head assembly which remains in the optimum configuration during cleaning. A still further object of the invention is to provide a cleaner head for a vacuum cleaner which has improved pick-up capabilities. A further object is to provide a cleaner head assembly which requires less maintenance than known assemblies.

The present invention provides a cleaner head assembly as claimed in claim 1. The invention also provides a vacuum cleaner as claimed in claim 10. Preferred features are set out in the subsidiary claims.

The cleaner head assembly according to the invention is doubly articulated with respect to the main body of the vacuum cleaner. This allows the brush housing to float freely on the surface to be cleaned even when the angle of inclination of the handle of the vacuum cleaner is altered during use. The suction opening in the brush housing thus remains essentially in the optimum configuration, ie horizontal, and the pick-up performance of the cleaner is thereby improved. The location of the brush bar in a brush housing which is sealed with respect to the cleaner head body and connected or connectable to a dirty air inlet in the main body of the housing maintains the freedom of movement of the brush housing during use but avoids the need to provide flexible seals between the brush housing and the cleaner head body which could become worn after an unacceptably short period of time. The connection between the brush housing and the main body of the vacuum cleaner is preferably formed by a flexible tube or hose which accommodates the relative movement between the brush housing and the main body without putting the seals under stress.

It is acknowledged that, during the normal forwards and backwards movement of the vacuum cleaner, the brush housing may be lifted away from the floor under the influence of the flexible tube or hose. As this is obviously undesirable a resilient member is preferably provided between the brush housing and the cleaner head body to counteract any lifting force acting on the brush housing. The resilient member acts between the cleaner head and the brush housing to press the rear of the brush housing downwardly. The resilient member is preferably a tension spring.

DETAILED DESCRIPTION OF THE DRAWING

An embodiment of the invention will now be described with reference to the accompanying drawings, wherein.

BRIEF DESCRIPTION OF THE INVENTION

Figure 1:
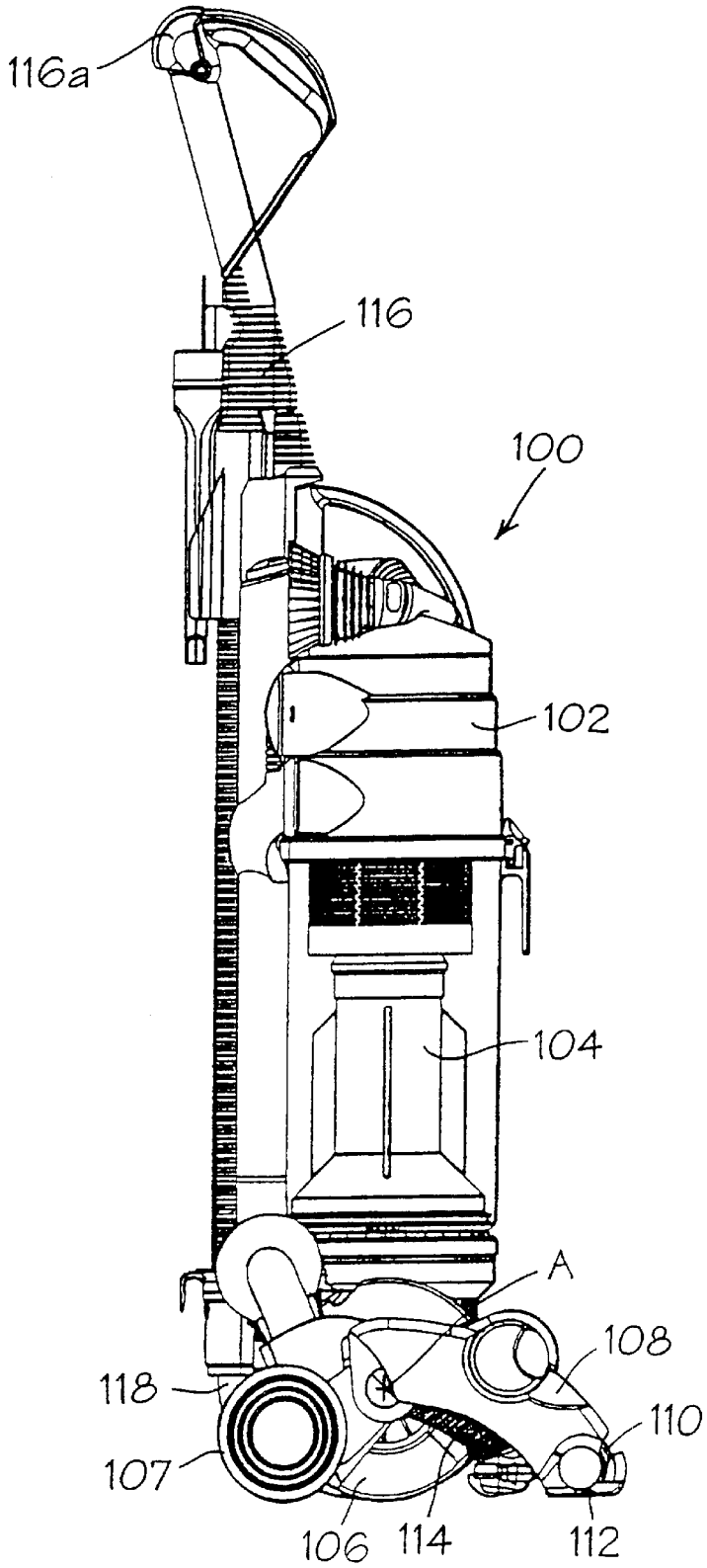
FIG. 1 is a side view of a vacuum cleaner incorporating a cleaner head assembly according to the present invention.
Figure 2:
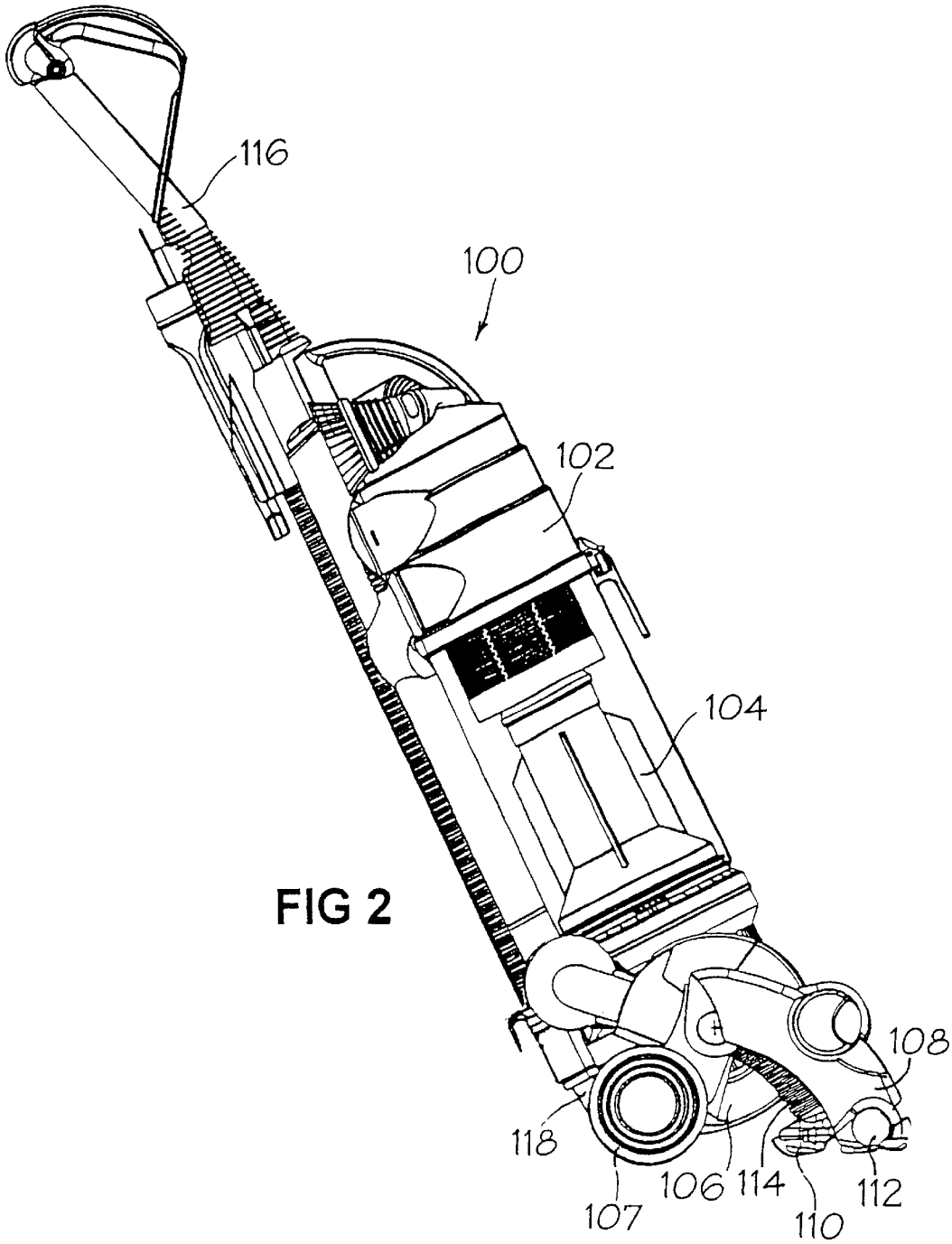
FIG. 2 is a side view of the vacuum cleaner of FIG. 1 with the handle shown in an inclined position.

FIGS. 1 and 2 illustrate the overall construction of an upright vacuum cleaner incorporating a cleaner head assembly according to the invention. The vacuum cleaner 100 has a main body 102 in which dust separation apparatus 104 is housed. In this embodiment the dust separation apparatus 104 comprises cyclonic dust separation apparatus consisting of two cyclones arranged in series. Apparatus of this type is well known and will not be described any further here because it has no material effect on the invention. A motor housing 106 is located at the lower end of the main body 102 and forms part of the main body 102. Supporting wheels 107 are mounted directly on the side of the motor housing 106. A cleaner head assembly 108 is rotatably mounted on the motor housing 106 about an axis A. The cleaner head assembly 108 has a brush housing 110 with a downward facing inlet 112 arranged at the forward end of the cleaner head assembly 108. A flexible duct 114 extends between the brush housing 110 and a dirty air inlet in the main body 102 which communicates with ducting which leads to the dust separation apparatus 104.

A handle 116 extends upwardly from the lower part of the main body 102 and lies alongside the rear part of the main body 102. When the cleaner 100 is to be used in the upright mode (as shown in FIG. 1), the handle 116 extends upwardly beyond the main body 102 so that it can be gripped by a user and used to manoeuvre the cleaner 100 across a surface to be cleaned. The handle 116 is, however, releasable and may alternatively be used as a hose and wand assembly. This can be achieved in several ways and examples are shown and described in EP 0 037 674 and EP 0 134 654. The lower end of the hose/wand 116 is also connected via ducting 118 to the dirty air inlet of the main body 102 to allow dirt and dust entering the cleaner 100 via the hose and wand to be passed to the dust separation apparatus 104.

A changeover valve (not shown) is provided in order that the appropriate inlet can be automatically selected for different modes of operation. When the cleaner 100 is in the position shown in FIG. 1, the changeover valve automatically connects the dust separating apparatus 104 to the wand and hose 116 so that cleaner can be used in cylinder mode for above the floor cleaning. Air is drawn into the cleaner through the distal end 116*a* of the wand which can be released from the cleaner for appropriate manipulation. The inlet 112 in the cleaner head assembly 108 is automatically shut off. When the cleaner 100 is to be used in conventional upright mode, the handle is restored to the position shown in FIG. 1 and then inclined to the vertical as shown in FIG. 2. The changeover valve automatically shuts off the air inlet at the distal end 116*a* of the wand and connects the dust separating apparatus 104 to the inlet 112 in the cleaner head assembly 108. The construction of the changeover valve does not form part of the present invention and will not be described any further here.

In all cases, ie in the upright mode and in the cylinder mode, a motor (not shown) located in the motor casing 106 drives a fan (also not shown) so as to draw air into the cleaner 100 via the appropriate inlet, conduct it to the dust separating apparatus 104 in the main housing 102 and then expel the cleaned air to the atmosphere. The cleaned air is preferably caused to flow past the motor so as to cool it before being expelled.

Figure 3:
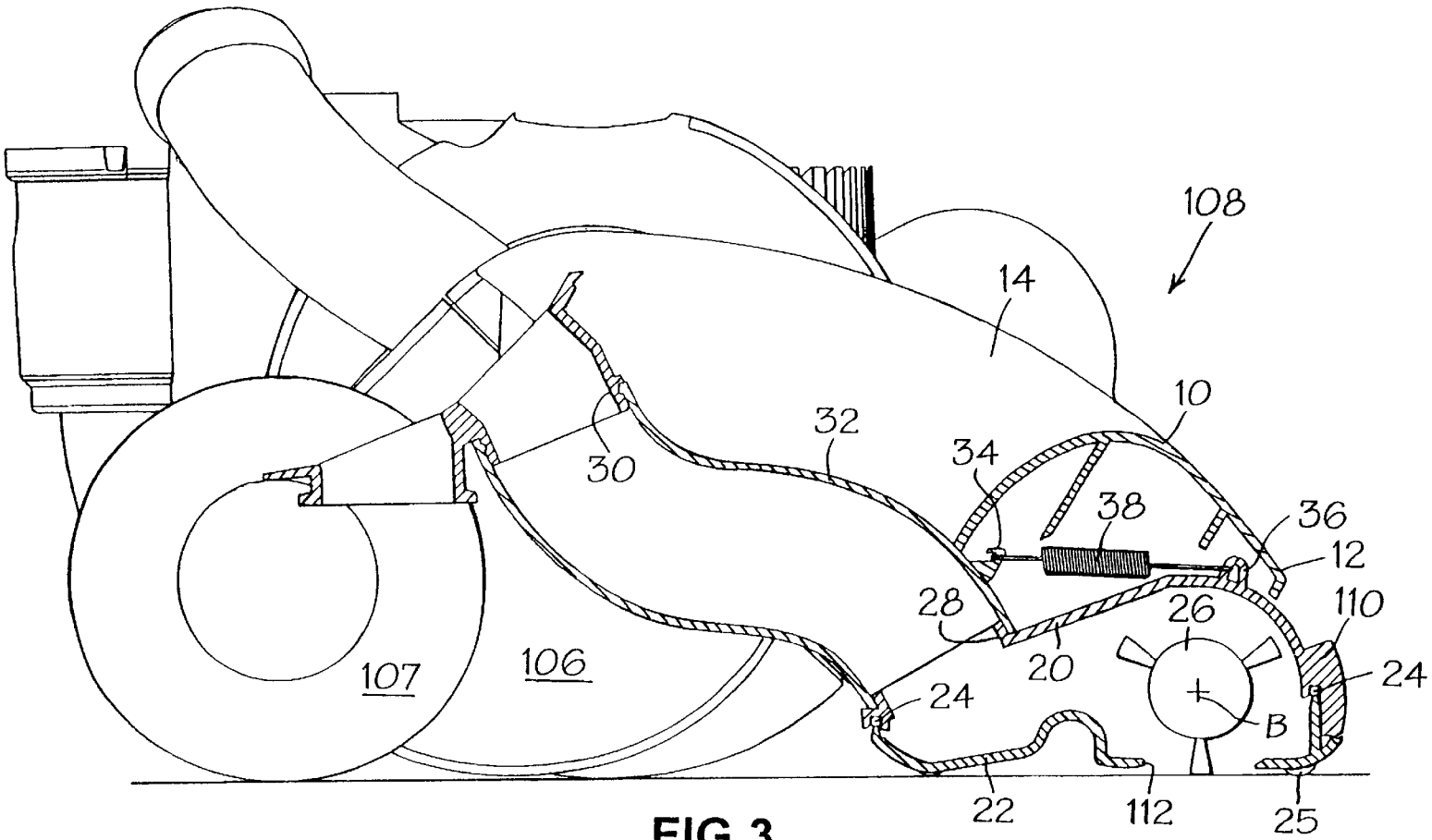
FIG. 3 is a sectional view of the cleaner head of the cleaner of FIGS. 1 and 2 in a first position.
Figure 4:
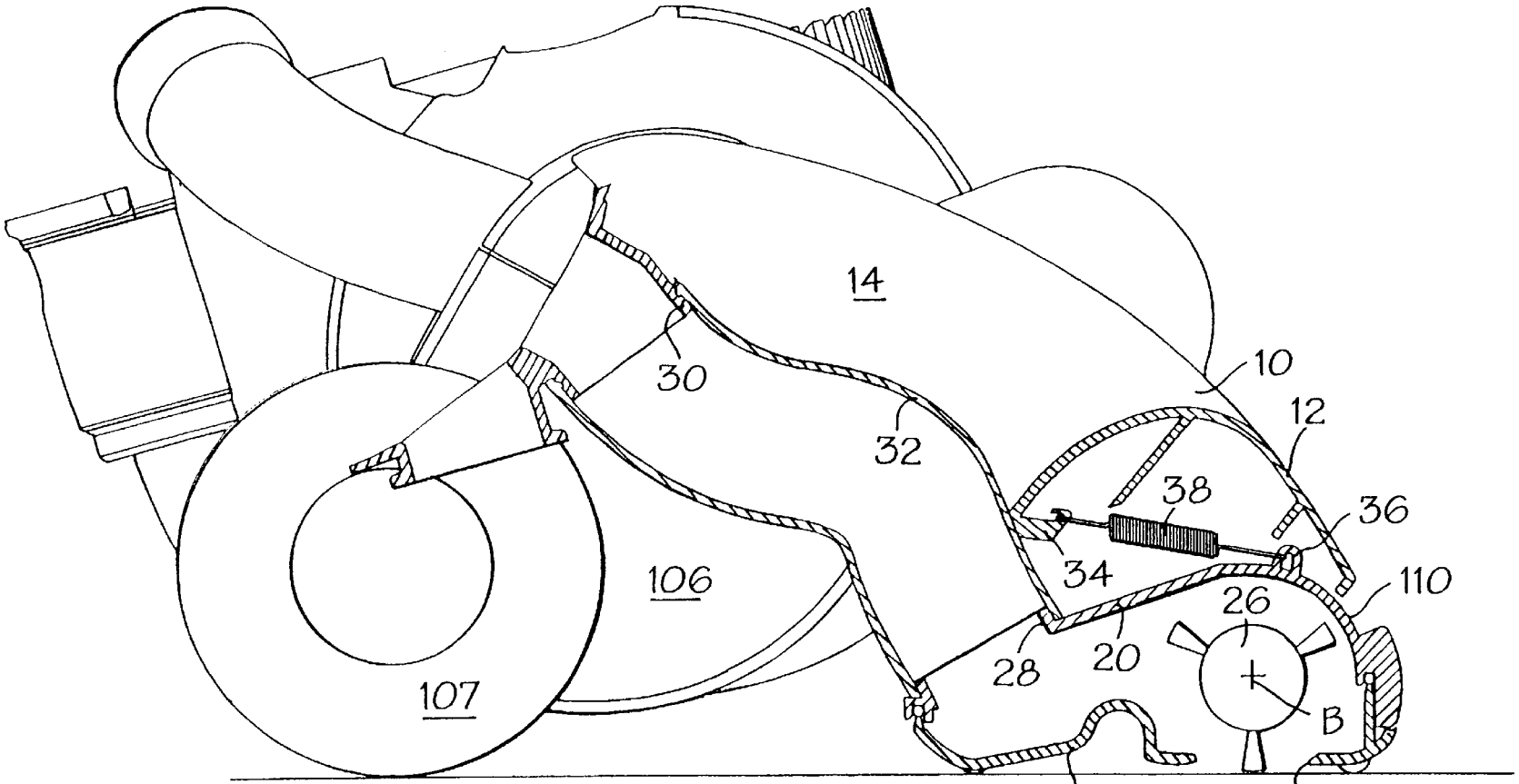
FIG. 4 is a sectional view of the cleaner head of the cleaner of FIGS. 1 and 2 in a second position.
Figure 5:
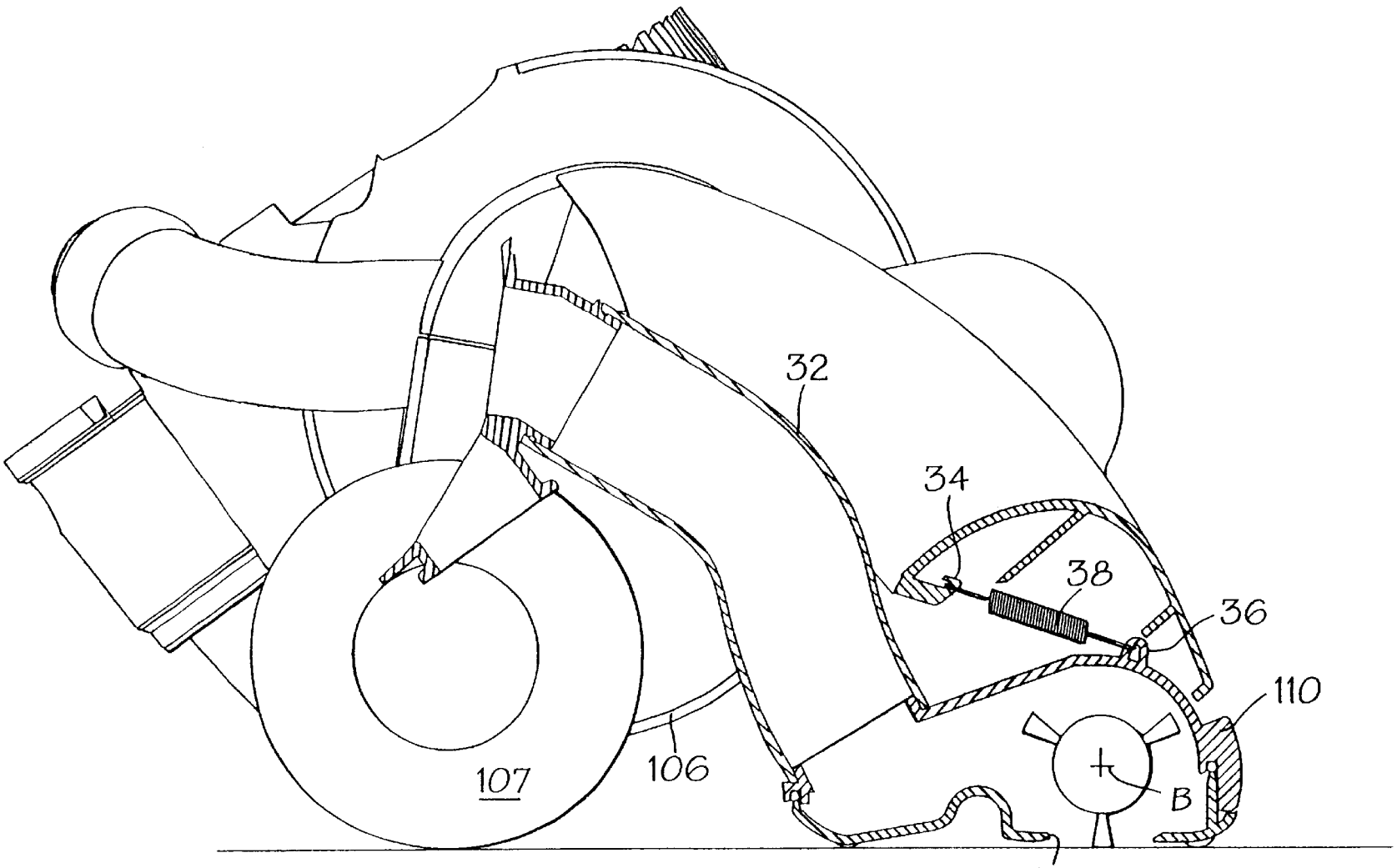
FIG. 5 is a sectional view of the cleaner head of the cleaner of FIGS. 1 and 2 in a third position.

FIGS. 3 to 5 show in more detail the cleaner head assembly 108 forming part of the vacuum cleaner 100 shown in FIGS. 1 and 2. The cleaner head assembly 108 has a cleaner head body 10 comprising a front portion 12 extending laterally across the width of the vacuum cleaner 100 and two rearwardly extending side arms 14 extending rearwardly from the side portions of the front portion 12. Each side arm 12 has a lug (not shown) which defines an aperture centred on the axis A about which the cleaner head assembly 108 is pivotably mounted on the motor casing 106. The cleaner head assembly 108 is mounted on the motor casing by way of pins which extend through the apertures in the lugs. The cleaner head assembly 108 pivots freely about the axis A so as to "float" on the floor to be cleaned without requiring the user to identify and set a predetermined level at which the cleaner head must operate.

The cleaner head assembly 108 includes a brush housing 110. The brush housing 110 is pivotably mounted on the front portion 12 of the cleaner head body 10 by way of lugs (not shown) depending from the side portions of the front portion 12. The brush housing 110 is manufactured from an upper plate 20 and a lower plate 22 which may be made from plastics material or a metal such as stainless steel. The upper and lower plates 20, 22 are joined together by quarter turn fasteners (not shown), by press-fitting or by other suitable means. A seal 24 is trapped between the upper and lower plates 20, 22 so as to ensure that the seal between the plates 20, 22 is essentially airtight. Rollers 25 are rotatably mounted at the front edge of the lower plate 22 to support the brush housing 110 on the carpet or other surface to be cleaned. The rollers 25 can be positioned at or adjacent the outer edges of the lower surface 22 or, alternatively, can either extend continuously or in a spaced manner across the entire width of the brush housing 110.

A suction opening 112 is formed in the lower plate 22. The suction opening 112 extends across the entire width of the brush housing 110. A brush bar 26 is rotatably mounted in the brush housing 110 so that the bristles of the brush bar 26 protrude slightly out of the suction opening 112. The axis B about which the brush bar 26 rotates is coincident with the axis about which the brush housing 110 is pivotably mounted on the front portion 12 of the cleaner head body 10.

The brush bar 26 is arranged to be drivable by the motor of the vacuum cleaner 100 in a conventional manner, for example, by way of a drive belt. The upper plate 20 of the brush housing 110 has a connection opening 28 for connecting the brush housing 110 to an air inlet 30 on the main body of the vacuum cleaner 100. A flexible tube 32 connects the connection opening 28 with the air inlet 30. The flexible tube 32 is made of any suitable material, for example, rubber or plastics. From the above, it can be seen that, in use, the only point of entry for air into the brush housing 110 is via the suction opening 112 and the only outlet is via the flexible tube 32 which leads to the main body of the vacuum cleaner and the dust separation apparatus. Dirty air entering the machine does not pass through any conduit or ducting arranged inside the cleaner head body 10 and therefore the need to seal the articulated brush housing 110 to the cleaner head body 10 is obviated. Seals can be provided at each end of the flexible tube 32 to ensure that the connections between the tube 32 and the respective part of the machine is airtight. However, neither seal is required to be flexed or placed under stress during movement of the vacuum cleaner when in use. The life of any such seals is therefore significantly longer than any seals which would be required to seal the brush housing 110 to the cleaner head body 10 in a movable manner.

A hooked projection 34 is provided on the rear of the interior surface of the front portion 12 of the cleaner head body 10. The hooked projection 34 extends forwardly and upwardly as shown in the drawings. An eye projection 36 is also provided on the upper surface of the upper plate 20 of the brush housing 110. The eye projection 36 is located forwardly of the hooked projection 34. Both projections 34, 36 are located upwardly of the axis B about which the brush housing 100 is pivotably mounted on the cleaner head body 10. A resilient member 38 extends between the hooked projection 34 and the eye projection 36. The resilient member 38 takes the form of a tension spring.

The function of the resilient member 38 is to bias the brush housing 110 in an anti-clockwise direction so that the rear portion of the brush housing 110 is pressed downwardly. The rear portion of the brush housing 110 is therefore maintained in contact with the surface to be cleaned. It will also counteract any lifting forces which might otherwise cause the rear portion of the brush housing 110 to be lifted away from the surface to be cleaned. Because the flexible tube 32 is made from a plastics material, the tube 32 may, under some circumstances, exert some upward lifting forces on the rear portion of the brush housing during normal use of the vacuum cleaner 100 and the resilient member 38 is designed to counteract these lifting forces.

FIG. 3 shows the relative positions of the motor casino 106, the cleaner head body 10 and the brush housing 110 when the vacuum cleaner 100 is to be used in cylinder mode (see FIG. 1). FIG. 4 shows the relative positions when the handle 116 of the vacuum cleaner 100 is inclined at a relatively small angle to the vertical and FIG. 5 shows the relative positions when the handle 116 of the vacuum cleaner 100 is inclined at a relatively large angle to the vertical. As the cleaner head 108 is moved backwards and forwards across the surface to be cleaned, the angle of inclination of the handle alters. The dual articulation of the brush housing 110 with respect to the main body 102 of the vacuum cleaner 100 (ie, the articulation of the cleaner head 108 about axis A and the articulation of the brush housing 110 about axis B) means that the brush housing 110 can remain in a substantially horizontal position at all angles of inclination of the handle 116. This is achieved partly as a result of the centre of gravity of the brush housing 110 being located rearwardly of the axis of articulation B. The weight of the brush housing 110 urges the rear portion of the brush housing 110 in a downward direction. Any downward force applied to the brush housing 110 by the flexible tube 32 will add to the urging of the brush housing 110 in the correct direction, as will the action of the resilient member 38. This means that the suction opening 112 will remain in a horizontal plane so as to remain in contact with the surface to be cleaned and maximum performance of the cleaner head is thus achieved. Maximum performance of the cleaner head improves the overall vacuum cleaner efficiency. The resilient member 38 also acts to urge the rear portion of the brush housing 110 downwards towards the surface to be cleaned. The rear portion of the brush housing 110 is thus pressed against the floor.

The invention is not limited to the precise details of the embodiment disclosed above. Modification not affecting the essence of the invention are intended to be included within the scope of the invention. For example, the tension spring could be replaced by any resilient member and the seal around the connection point 28 could be formed by any airtight material. Other modifications and variations will be apparent to a skilled reader.

What is claimed is:

1. A cleaner head assembly for a vacuum cleaner, the vacuum cleaner comprising a main body having an air inlet for introducing dirty air thereinto, the cleaner head assembly comprising:

a cleaner head body pivotably attachable about a first axis to a main body of a vacuum cleaner, and a brush housing being a sealed unit pivotably mounted about a second separate axis on the cleaner head body;

a suction opening formed in the brush housing and having a brush bar mounted about a third axis therein;

a conduit, separate from the cleaner head body, connected to the sealed unit and connectable to the air inlet to carry dirty air from the brush housing to the main body.

2. A cleaner head assembly as claimed in claim 1, wherein the second axis is coincident with the third axis.

3. A cleaner head assembly as claimed in claim 1, wherein the first axis is parallel to the second axis.

4. A cleaner head assembly as claimed in claim 1, wherein the conduit comprises a flexible tube or hose.

5. A cleaner head assembly as claimed in claim 1, wherein the brush housing comprises a front portion and a rear portion, the brush bar being located in the front portion and the conduit being connected to the rear portion.

6. A cleaner head assembly as claimed in claim 1, further comprising a resilient member provided between the cleaner head body and the brush housing to bias the brush housing in a predetermined direction of pivoting with respect to the cleaner head body.

7. A cleaner head assembly as claimed in claim 6, wherein the resilient member acts so as to urge the rear portion of the brush housing in a downward direction.

8. A cleaner head assembly as claimed in claim 6, wherein the resilent member comprises a tension spring.

9. A vacuum cleaner comprising a main body having an air inlet for introducing dirty air thereinto, and a cleaner head assembly comprising:

a cleaner head body pivotably attached about a first axis to the main body;

a brush housing being a sealed unit pivotably mounted about a second axis on the cleaner head body;

a suction opening formed in the brush housing and having a brush bar rotatably mounted about a third axis therein;

a conduit, separate from the cleaner head body, connected to the sealed unit and to the air inlet to carry dirty air from the brush housing to the main body.

10. A cleaner head assembly for a vacuum comprising:

a cleaner head body pivotably attachable about a first axis to a main body of a vacuum cleaner;

a brush housing pivotably mounted about a second separate axis on the cleaner head body and having a brush bar mounted therein;

said brush housing comprising an upper part, a lower part, and a seal located between said upper part and said lower part.

11. A cleaner head assembly as claimed in claim 10, further comprising a conduit connected at one end to the brush housing and connectable at the other end to an air inlet on the main body of the vacuum cleaner.

12. A cleaner head assembly as claimed in claim 10, wherein the brush bar is mounted about said second axis.

13. A cleaner head assembly as claimed in claim 10, wherein the axis of the brush bar is located in a front portion of the brush housing.

14. A cleaner head assembly as claimed in claim 11, wherein the conduit comprises a flexible tube or hose.

15. A cleaner head assembly as claimed in claim 14, wherein the brush housing comprises a front portion and a rear portion, and wherein the brush bar is located in the front portion of the brush housing.

16. A cleaner head assembly as claimed in claim 15, wherein the conduit is connected to the rear portion of the brush housing.

17. A cleaner head assembly as claimed in claim 10, wherein the cleaner head assembly further comprises a resilient member provided between the cleaner head body and the brush housing to bias the brush housing in a predetermined direction of pivoting with respect to the cleaner head body.

18. A cleaner head assembly as claimed in claim 17, wherein the resilient member acts so as to urge the rear portion of the brush housing in a downward direction.

19. A cleaner head assembly as claimed in claim 17, wherein the resilient member comprises a tension spring.

* * * * *